US006499265B2

(12) United States Patent
Shreiner

(10) Patent No.: US 6,499,265 B2
(45) Date of Patent: Dec. 31, 2002

(54) EXPANSION JOINT COVER

(75) Inventor: Thomas A. Shreiner, Picture Rocks, PA (US)

(73) Assignee: Construction Specialties, Inc., Lebanon, NJ (US)

( * ) Notice: Subject to any disclaimer, the term of this patent is extended or adjusted under 35 U.S.C. 154(b) by 0 days.

(21) Appl. No.: 09/941,269

(22) Filed: Aug. 28, 2001

(65) Prior Publication Data

US 2002/0032997 A1 Mar. 21, 2002

Related U.S. Application Data

(60) Provisional application No. 60/233,078, filed on Sep. 15, 2000.

(51) Int. Cl.[7] ..... E04F 15/14

(52) U.S. Cl. ..... 52/393; 52/394; 52/395; 52/468; 52/466; 404/68; 404/396.04; 404/396.05

(58) Field of Search ..... 52/393, 461, 463, 52/394, 395, 396.06, 396.09, 573.1, 396.02, 396.03, 396.05, 396.04, 468, 471, 466; 404/68

(56) References Cited

U.S. PATENT DOCUMENTS

| | | | | | |
|---|---|---|---|---|---|
| 3,270,474 | A | * | 9/1966 | Driggers | 52/287 |
| 3,474,589 | A | * | 10/1969 | Cheatwood | 52/287 |
| 3,659,390 | A | * | 5/1972 | Balzer et al. | 52/464 |
| 3,696,575 | A | * | 10/1972 | Armstrong | 52/287 |
| 4,566,242 | A | | 1/1986 | Dunsworth | |
| 5,078,529 | A | * | 1/1992 | Moulton | 403/24 |
| 5,228,255 | A | | 7/1993 | Hahn | |
| 5,799,456 | A | * | 9/1998 | Shreiner et al. | 52/396.04 |
| 5,829,216 | A | * | 11/1998 | Newcomb et al. | 52/395 |
| 6,014,848 | A | | 1/2000 | Hilburn, Jr. | |
| 2002/0095895 | A1 | * | 7/2002 | Daly et al. | 52/464 |

OTHER PUBLICATIONS

Balco Inc. Catalog, 2000, p. 18, Heavy Duty Joint Covers HPG375 Parking Garage Expansion Joint Cover System.

* cited by examiner

*Primary Examiner*—Jose V. Chen
*Assistant Examiner*—Dennis L. Dorsey
(74) *Attorney, Agent, or Firm*—Baker Botts L.L.P.

(57) ABSTRACT

An expansion joint cover for bridging an expansion gap between first and second building floor members has a pivot frame adapted to be affixed to the first building floor member, the pivot frame including a base portion and a longitudinally continuous bearing of spherical cross-section supported by and located above the base portion, and a slide frame adapted to be affixed to the second building floor member. A cover unit is pivotally mounted in spaced-apart relation to a proximal end thereof on the bearing in cantilevered relation to the bearing, is adapted to span the gap, and has a distal end supported on the slide frame. A plurality of spaced-apart compression spring units engaged between the base portion of the pivot frame and a portion of the cover unit intermediate the proximal end and the bearing bias the cover unit about the bearing so as to forcibly engage the distal end of the cover unit with the slide frame.

15 Claims, 3 Drawing Sheets

EXPANSION JOINT COVER

This Application claims the benefit of Provisional application No. 60/233,078, filed Sep. 15, 2000.

Background of the Invention

The present invention relates to expansion joint covers for bridging the expansion gaps between building floors and, in particular, to heavy duty expansion joint covers suitable for the floors of structures such as parking decks and parking garages.

In settings such as parking garages and parking decks where vehicles traverse expansion joints, expansion joint covers are subjected to heavy loads, abrasion, water intrusion and other harsh environmental conditions, special attention is needed in designing expansion joint covers that are strong, durable, resistant to deterioration, and capable of being easily serviced and repaired. All parts that the wheels of vehicles travel on should be of metal—elastomeric seals are not sufficiently durable to be long-lasting. The predominant use of metal parts gives rise to noise problems, which are highly objectionable to pedestrians both inside and outside the structure.

SUMMARY OF THE INVENTION

An object of the present invention is to provide an expansion joint cover that is "rattle-free," provides for relative movements of the floors on opposite sides of the expansion gap toward and away from each other ("x-axis motion"), parallel to each other lengthwise of the expansion gap ("y-axis motion"), and vertically ("z-axis motion"), is relatively inexpensive to produce, is easy to install, allows for on-site adjustment of a "hold-down" force, and can be readily disassembled for service and repair.

The foregoing objects are attained, according to the present invention, by an expansion joint cover for bridging an expansion gap between first and second building floor members that has a pivot frame adapted to be affixed to the first building floor member, the pivot frame including a base portion and a longitudinally continuous bearing of spherical cross-section supported by and located above the base portion, and a slide frame adapted to be affixed to the second building floor member. A cover unit is pivotally mounted in spaced-apart relation to a proximal end thereof on the bearing in cantilevered relation to the bearing, is adapted to span the gap, and has a distal end supported on the slide frame. A plurality of spaced-apart compression spring units engaged between the base portion of the pivot frame and a portion of the cover unit intermediate the proximal end and the bearing bias the cover unit about the bearing so as to forcibly engage the distal end of the cover unit with the slide frame.

One advantage of an expansion joint cover according to the invention, as described thus far, is that the cover unit is firmly "pre-tensioned" with respect to both the pivot frame and the slide frame, which eliminates any looseness that can produce bothersome rattling. A further advantage is that the pre-tensioning is provided by a structure of relatively simple and low-cost construction, a series of compression spring units associated with one frame but acting on both frames—the spring units tighten the cover unit to the bearing on the pivot frame by forces acting upwardly on the proximal end of the cover unit and tighten the cover unit to the slide frame by forces acting downwardly on the distal end of the cover unit.

It is possible for the cover unit to be made in one piece (e.g., an extruded unitary cover and socket) or two pieces (e.g., a cover plate and a separate one-piece pivot block). Such constructions, however, have the disadvantages of requiring a relatively large clearance between the socket and bearing to allow for tolerance variations while permitting assembly by endwise sliding, of not being readily disassembled for repair, presenting difficulties in installing the springs, and limiting the materials of the cover unit and the manufacturing techniques for making the cover unit. Thus, it is preferred that the cover unit be an assembly that includes a cover plate, a first elongated continuous pivot block attached to the cover plate, and a second elongated continuous pivot block attached to the cover plate, each pivot block having a socket portion engaging a circumferential portion of the bearing. The cover plate may be fabricated from plate material, which may be aluminum, stainless steel, galvanized steel or a composite material. The two-part construction of the pivot block allows it to be installed without endwise sliding and permits disassembly and removal from the bearing. Preferably, the socket portions of the two pivot blocks have contiguous surfaces, the cover plate is attached to each of the pivot blocks by threaded fasteners, and the socket portion of each of the pivot blocks receives a spline of a resilient polymeric material to take up tolerance variations. A lubricant is provided at interfaces between the bearing and the socket portions of the pivot blocks.

Assembly is facilitated by interconnecting the pivot blocks by mating hook portions, which are arranged such that the second pivot block can be fitted to the bearing and interconnected to the first pivot block after the first pivot block is fitted to the bearing. The interconnection keeps the two pivot blocks joined to each other while the cover plate is attached to the second pivot block.

In advantageous embodiments, the first pivot block is located generally proximally of the bearing, the socket portion of the first pivot block is substantially semi-cylindrical so as to have a portion underlying the bearing and a portion overlying the bearing, the second pivot block is located distally of the bearing, and the socket portion of the second pivot block has a portion underlying the bearing. The underlying portions of the first and second pivot blocks retain the cover unit on the bearing against upward displacement, and the overlying portion of the first pivot block supports the cover unit on the bearing against downward loads. The first pivot block includes a flange portion located proximally of the socket portion and is fastened to the cover plate by screws that pass from above the cover plate through holes in the cover plate and are threaded into holes in the flange portion. The second pivot block includes a longitudinally continuous upwardly open nut groove receiving spaced apart nuts, and the cover plate is fastened to the second pivot block by bolts that pass from above the cover plate through holes in the cover plate and are threaded into the nuts.

According to another preferred aspect of the present invention, each of the compression spring units is received between the base portion of pivot frame and the flange portion of the first pivot block. Each spring unit includes a spring retainer that is affixed to and dependent from the underside of the flange portion of the first pivot block. The spring retainer of each spring unit is tubular, has internal threads, and receives an externally threaded spring force adjuster against which the upper end of the spring bears, the adjuster being accessible through a hole in the flange portion of the first pivot block and a hole in the cover plate so that the spring force of the spring is adjustable after the cover plate is installed. Adjustable spring units facilitate installation of the expansion joint cover by allowing the springs to be installed in an unloaded condition before the pivot blocks are assembled to the bearing and allow predetermined spring loads to be applied with the expansion joint cover nearly fully installed. Advantageously, the holes providing access to the spring adjuster are the holes in the cover plate and the first pivot block that receive the screws by which the cover plate is fastened to the first pivot block.

The springs of the spring unit may be mechanical coil springs, mechanical leaf springs, mechanical disc springs, elastomeric pads or blocks, and springs that include fluids.

DESCRIPTION OF THE DRAWINGS

For a more complete understanding of the present invention, and the advantages thereof, reference may be made to the following written description of an exemplary embodiment, taken in conjunction with the accompanying drawings.

DESCRIPTION OF THE EMBODIMENT

Figure 1:
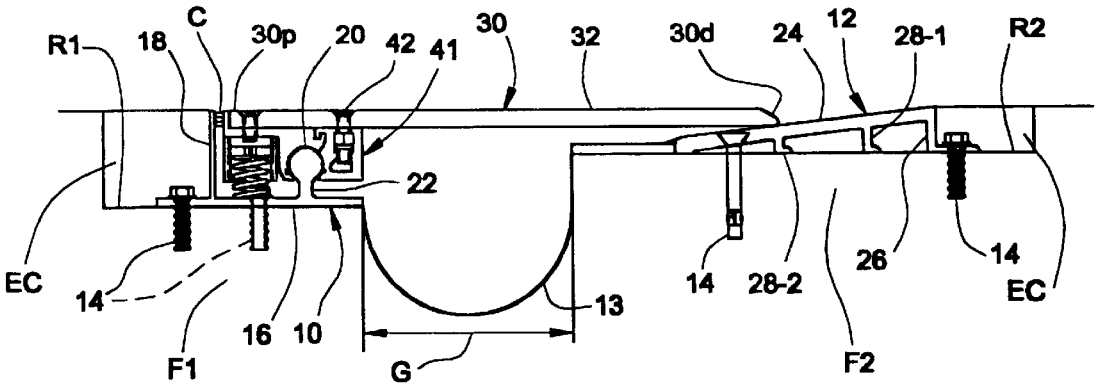
FIG. 1 is an end elevational view of the embodiment as installed in building floors, showing it in the "nominal" condition of z-axis relative displacement.
Figure 2:
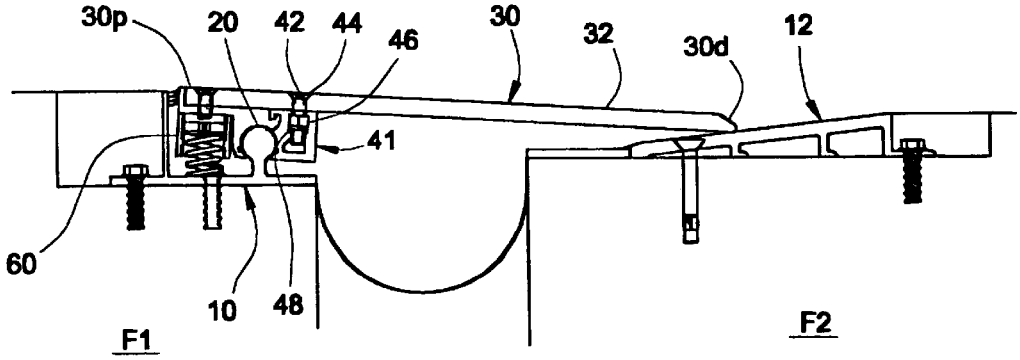
FIG. 2 is an end elevational view of the embodiment, showing it in a "down" condition of z-axis relative displacement of the floors.
Figure 3:
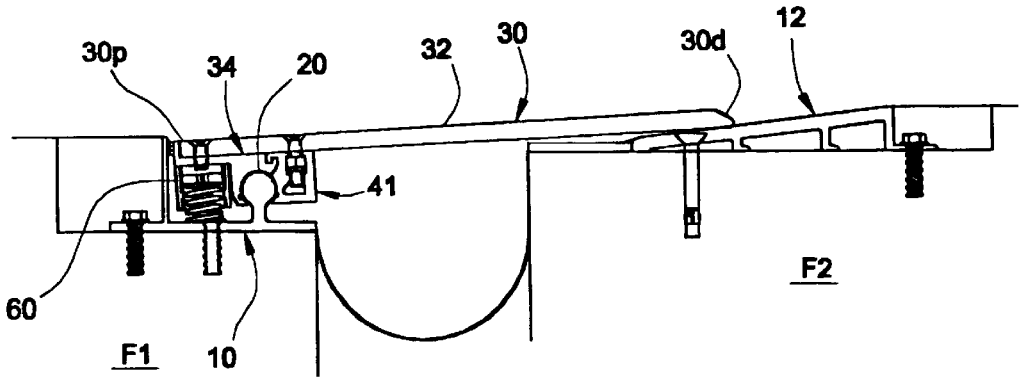
FIG. 3 is an end elevational view of the embodiment, showing it in an "up" condition of z-axis relative displacement.
Figure 4:
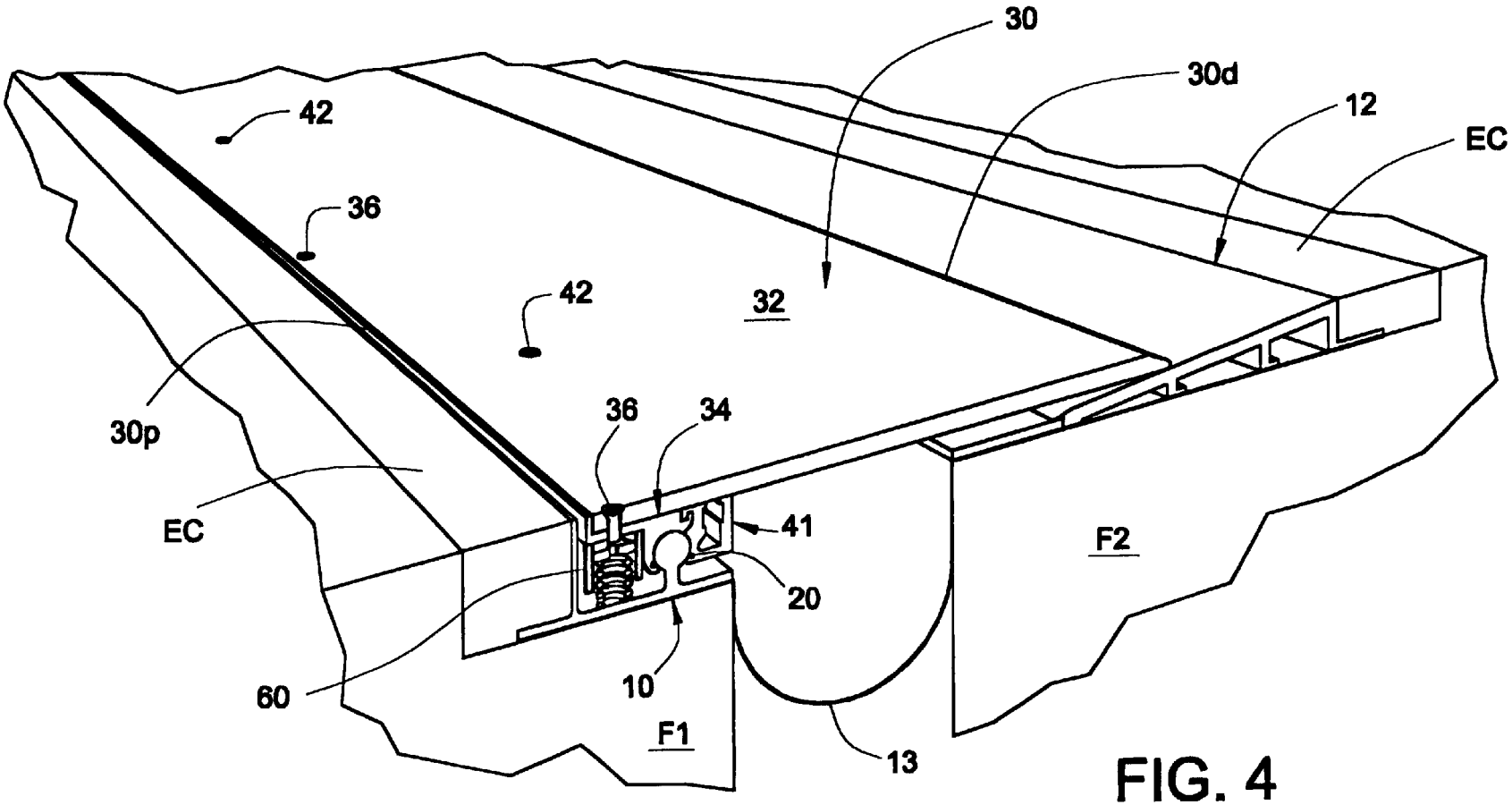
FIG. 4 is a perspective three-quarter end view of the embodiment, taken from a vantage point above and to the left (as compared with FIGS. 1 to 3)

The embodiment is shown in FIGS. 1 to 3 installed at an expansion gap G between structural concrete floors F1 and F2 of structurally separate sections of a building. When the floors are poured, a recess R1 is blocked out in the floor F1 to receive a pivot frame 10 of the expansion joint cover, and a recess R2 is blocked out in the floor F2 to receive a slide frame 12. In the first step of installing the expansion joint cover, a water stop 13 of a suitable flexible, water-impermeable material is set in place on the surfaces of the recesses, leaving a loop in the gap G, and the respective frames 10 and 12 are placed over the water stop in the recesses and secured to the floors by masonry bolts 14.

The pivot frame 10 is a piece cut to length from an aluminum extrusion and includes a base portion 16, an upright flange portion 18, and a bearing 20 of circular cross-section, which is located above the base and is supported by a rib portion 22. The slide frame 12, which is also piece of an aluminum extrusion, has a sloping cover support web portion 24, an L-shaped terminal flange portion 26, and mounting leg portions 28-1 and 28-2.

A cover unit 30 is pivotally mounted in a location spaced apart from its proximal end 30*p* on the bearing 20 of the pivot frame 10, spans the expansion gap G, and is supported at its distal end 30*d* on the cover support web portion 24 of the slide frame 12. The cover unit includes a cover plate 32, which is fabricated from a plate material and, as mentioned above, may be of aluminum, stainless steel, galvanized steel or a composite material. The cover plate may be curved in the transverse direction(x-axis).

Figure 5:
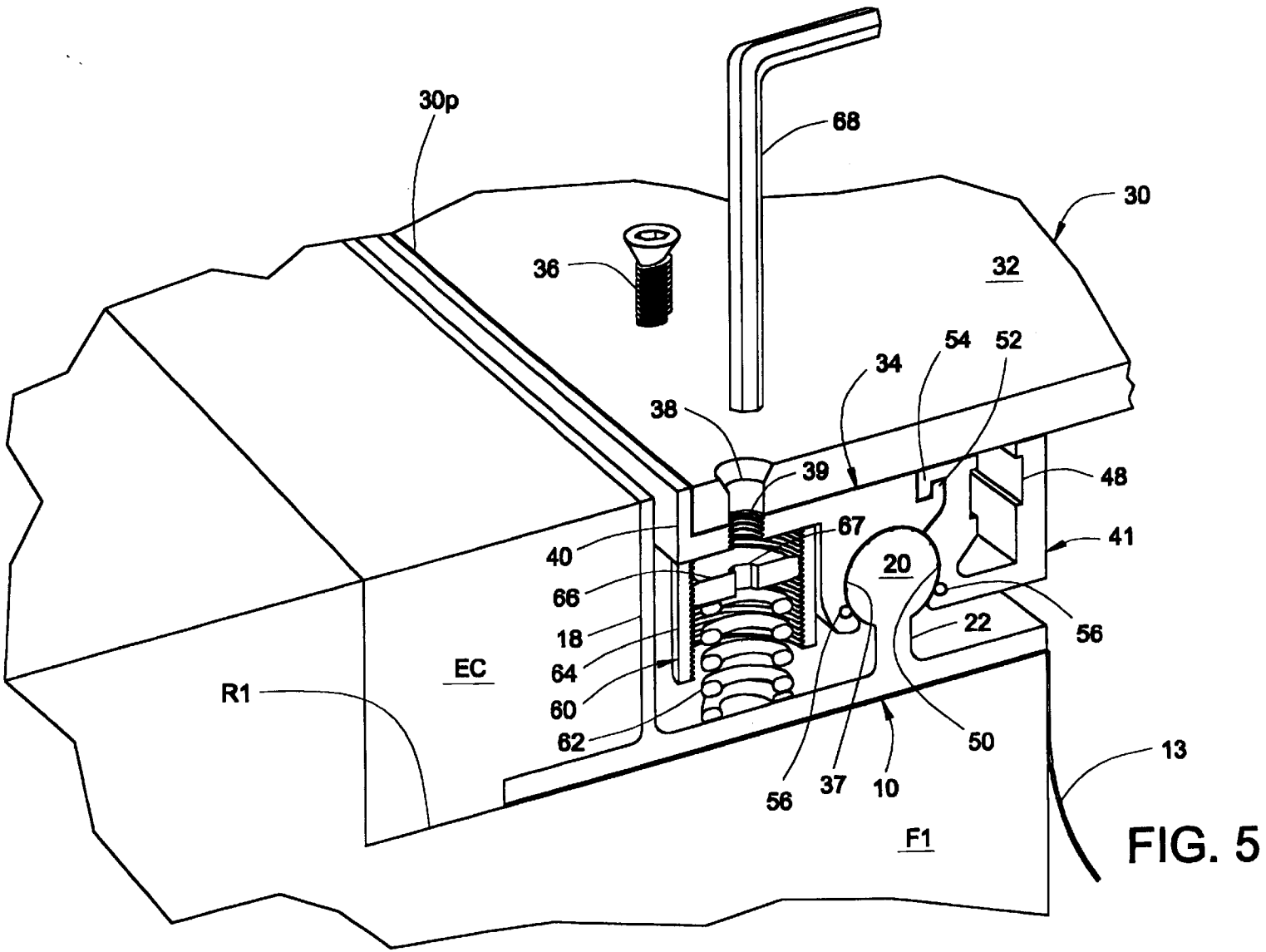
FIG. 5 is an exploded detailed perspective view of the pivoting side of the embodiment.

As may best be seen in FIG. 5, a first longitudinally continuous pivot block 34 (an aluminum extrusion) is secured to the underside of the proximal end portion of the cover plate 32 by screws 36, which pass from above the cover plate through holes 38 drilled in the cover plate and thread into tapped holes 39 in an L-shaped flange portion 40 of the pivot block 34. A socket portion 42 of the first pivot block 34 presents a semi-cylindrical bearing surface that extends circumferentially of the bearing 20 from the underside over the apex such that the socket has a portion underlying the bearing and a portion overlying the bearing.

A second longitudinally continuous pivot block 41 (also an aluminum extrusion) is secured (see FIG. 2) to the underside of the proximal end portion of the cover plate 32 by screws 42, which pass from above the cover plate through holes 44 drilled in the cover plate and thread into nuts 46 that are received in a nut groove 48 of the second pivot block 41. A socket portion 50 of the second pivot block 41 (FIG. 5) presents a bearing surface that is contiguous to the socket of the first bearing block 34.

To facilitate installation of the expansion joint cover, as described below, the pivot blocks have interengaging hooks 52 and 54. Each pivot block receives and resilient spline of a polymeric material in a groove. The splines take up tolerance variations in the extrusions and tighten the bearing block assembly to the bearing.

The cover unit is pre-loaded as installed in the floors so as to provide an upward force at the proximal support location, the bearing of the pivot frame, and a downward force at the distal support location, the sloping web portion of the slide frame, by longitudinally spaced-apart spring assemblies 60 (FIG. 5), thus to make the expansion joint cover "rattle free." Each spring assembly 60 includes a compression spring 62, which may, as mentioned above, be a mechanical coil spring (shown), a mechanical leaf spring, a mechanical disc spring, an elastomeric pad or block, or a spring that includes a fluid. The spring 62 is received in a spring retainer tube 64, which is internally threaded and receives an externally threaded spring force adjuster 66 against which the upper end of the spring 62 bears. The adjuster 66 is rotated by inserting into a socket 67 in the adjuster 66 a hex key 68 through the hole 38 in the cover plate 32 and the hole 39 in the first pivot block 34 that receive the screw 36 by which the cover plate is fastened to the first pivot block.

The spring assemblies are, preferably, installed on the first pivot block at the place of manufacture of the expansion joint cover. The spring retainer tubes 64 are welded to the flange portion 40 and the force adjusters 66 are threaded into them far enough to receive the springs 62 without any preload being introduced at the time of initial fitting of the first pivot block 34 to the bearing 20 and fastening of the cover plate to the second pivot block, as described below. The springs 62 are inserted into the tubes and secured by tape.

After the pivot frame 10 and slide frame 12 are installed in the floor recess R1 and R2, as described above, a lubricant is applied to the bearing 20, and the first pivot block 34 and the second pivot block 41 are fitted to the bearing 20. The hooks 52 and 54 interconnect the pivot blocks so that they are held together in place on the bearing during the remainder of the installation process (and indeed thereafter). The cover plate 32 is set down on the pivot blocks and is fastened by the screws 42 to the second pivot block 41. Using the key 68 and a torque wrench set to apply a torque to the adjusters 66 such as to preload the springs 62 with a desired force, the springs are preloaded.

At some stage in the installation process, the gaps between the frames 10 and 12 and the side walls of the recesses R1 and R2 are filled with a suitable filler EC, such as elastomeric concrete or a grout. After the expansion joint cover is installed, the gap between the flange portion 40 of the first pivot block 34 and the flange portion 18 of the pivot frame 10 is filled with an elastomeric caulking C.

As FIGS. 1 to 3 show, the z-axis relative motions of the floors F1 and F2 are accommodated by pivoting of the cover unit 30 about the bearing 20. In all relative positions, the spring units 60 maintain the cover unit pre-loaded to prevent rattling. X-axis relative motions of the floors F1 and F2 also produce pivotal movement of the cover unit about the bearing, because of the sloping slide frame web 24 that supports the distal edge of the cover plate. Y-axis motions are permitted by sliding of the distal edge of the cover plate lengthwise of the gap along the slide frame.

The expansion joint cover can easily be serviced and repaired by detaching the cover plate. If servicing involves only resetting the spring pre-loads, the screws 36 can be removed to provide access to the adjusters 66.

What is claimed is:

1. An expansion joint cover for bridging an expansion gap between first and second building floor members, comprising a pivot frame adapted to be affixed to the first floor building member, the pivot frame including a base portion and a longitudinally continuous bearing of spherical cross-section supported by and above the base portion, a slide frame adapted to be affixed to the second building floor member, a cover unit pivotally mounted in spaced-apart relation to a proximal end thereof on the bearing in cantilevered relation to the bearing, adapted to span the gap, and having a distal end supported on the slide frame, and a plurality of spaced-apart compression spring units engaged between the base portion of the pivot frame and a portion of the cover unit intermediate the proximal end and the bearing and biasing the cover unit about the bearing so as to forcibly engage the distal end of the cover unit with the slide frame.

2. The expansion joint cover according to claim 1, wherein the cover unit is an assembly that includes a cover plate, a first elongated continuous pivot block attached to the cover plate, and a second elongated continuous pivot block attached to the cover plate, each pivot block having a socket portion engaging a circumferential portion of the bearing.

3. The expansion joint cover according to claim 2, wherein the socket portions of the pivot blocks have contiguous surfaces.

4. The expansion joint cover according to claim 2, wherein the cover member is attached to each of the pivot blocks by threaded fasteners inserted from above the cover member into holes in the cover member.

5. The expansion joint cover according to claim 2, the socket portion of each of the pivot blocks receives a spline of a resilient polymeric material.

6. The expansion joint cover according to claim 2, wherein a lubricant is provided at interfaces between the bearing and the socket portions of the pivot blocks.

7. The expansion joint cover according to claim 2, wherein the pivot blocks are interconnected by mating hook portions arranged such that the second pivot block can be fitted to the bearing and interconnected to the first pivot block after the first pivot block is fitted to the bearing.

8. The expansion joint cover according to claim 2, wherein the first pivot block is located generally proximally of the bearing, the socket portion of the first pivot block is substantially semi-cylindrical so as to have a portion underlying the bearing and a portion overlying the bearing, the second pivot block is located distally of the bearing, and the socket portion of the second pivot block has a portion underlying the bearing, the underlying portions of the first and second pivot blocks retaining the cover unit on the bearing against upward displacement and the overlying portion of the first pivot block supporting the cover unit on the bearing against downward loads.

9. The expansion joint cover according to claim 8, wherein the pivot blocks are interconnected by mating hook portions arranged such that the second pivot block can be fitted to the bearing and interconnected to the first pivot block after the first pivot block is fitted to the bearing.

10. The expansion joint cover according to claim 8, wherein the first pivot block includes a flange portion located proximally of the socket portion and is fastened to the cover plate by screws that pass from above the cover plate through holes in the cover plate and are threaded into holes in the flange portion.

11. The expansion joint cover according to claim 8, wherein the second pivot block includes a longitudinally continuous upwardly open nut groove receiving spaced apart nuts and the cover plate is fastened to the second pivot block by bolts that pass from above the cover plate through holes in the cover plate and are threaded into the nuts.

12. The expansion joint cover according to claim 10, wherein each of the compression springs is an element of a spring unit that is received between the base portion of pivot frame and the flange portion of the first pivot block.

13. The expansion joint cover according to claim 10, wherein each spring unit includes a spring retainer that is affixed to and dependent from the underside of the flange portion of the first pivot block.

14. The expansion joint cover according to claim 13, wherein the spring retainer of each spring unit is tubular, has internal threads, and receives an externally threaded spring force adjuster against which the upper end of the spring bears, the adjuster being accessible through a hole in the flange portion of the first pivot block and a hole in the cover plate so that the spring force of the spring is adjustable after the cover plate is installed.

15. The expansion joint cover according to claim 14, wherein the holes providing access to the spring adjuster are the holes in the cover plate and the first pivot block that receive the screws by which the cover plate is fastened to the first pivot block.

* * * * *